US006672499B1

(12) United States Patent
Lee

(10) Patent No.: US 6,672,499 B1
(45) Date of Patent: Jan. 6, 2004

(54) TOP LOADING STAPLE CASSETTE

(76) Inventor: Ying-Chou Lee, No. 9, Alley 9, Lane 42, Lung Feng Street, Fengyuan (TW)

( * ) Notice: Subject to any disclaimer, the term of this patent is extended or adjusted under 35 U.S.C. 154(b) by 0 days.

(21) Appl. No.: 10/455,362

(22) Filed: Jun. 6, 2003

(51) Int. Cl.[7] ..... B25C 1/04
(52) U.S. Cl. ..... 227/120; 227/134
(58) Field of Search ..... 227/120, 109, 227/134, 136, 132

(56) References Cited

U.S. PATENT DOCUMENTS 3,883,064 A * 5/1975 Hilgers ..... 227/120
4,826,066 A * 5/1989 Koester et al. ..... 227/134
5,655,697 A * 8/1997 Yeh ..... 227/120
5,931,364 A * 8/1999 Dennis ..... 227/109
5,931,365 A * 8/1999 Huang ..... 227/120
6,062,456 A * 5/2000 Patti et al. ..... 227/134
6,494,356 B1 * 12/2002 Frank ..... 227/120
6,550,660 B1 * 4/2003 Chlebowski et al. ..... 227/134

* cited by examiner

*Primary Examiner*—Scott A. Smith
(74) *Attorney, Agent, or Firm*—Bacon & Thomas, PLLC

(57) ABSTRACT

A staple cassette for a stapler includes a base member having two side walls and a pushing member are movably mounted onto the two side walls of the base member. A first hook extends from an underside of the base member and located close to a first end of the base member, and an opening is defined through the underside of the base member and located close to a second end of the base member. The pushing member has a second hook extending from an underside there. A spring has a first end hooked to the first hook on the base member and a second end of the spring extends through the opening and engaged with the second hook. A cover is mounted to the base member and includes an opening defined through the top of the cover. A top piece is slidably engaged with the opening of the cover.

5 Claims, 8 Drawing Sheets

TOP LOADING STAPLE CASSETTE

FIELD OF THE INVENTION

The present invention relates to a top loading staple cassette that has a top piece removable engaged with the top opening of the cover on the base member and staples are inserted from a top of the cassette.

BACKGROUND OF THE INVENTION

A conventional staple cassette 10 for staplers is disclosed in FIGS. 1 and 2, and generally includes a base member 12 having two side walls 122 on a top thereof and a plurality of connection protrusions 121 extend laterally from two sides of the base member 12. A cover 11 has two side walls and a close top, and a plurality of holes 111 are defined through the side walls of the cover 11 so that the cover 11 may be mounted to the base member 12 with the two side walls 122 of the base member 12 located inside of the two side walls of the cover 11, and the protrusions 121 engaged with the holes 111. A slot 113 is defined through an end of the close top of the cover 11 so that a pushing plate (not shown) connected to an arm of the stapler is movably inserted in the slot 113. A cap 14 includes a rod 141 which is connected to a head 142. Two lugs 144 extend from a side of the head 142 and each of which has a hook 143 on an outside thereof The hooks 143 are engaged with positioning holes 112 defined in the two side walls of the cover 11. A spring 15 is mounted to the rod 141 and a pushing member 13 has a connection port 132 which is connected to a distal end of the spring 15 so that the staples 123 mounted across the two side walls 122 are urged by the two sides 131 of the pushing member 13.

When reloading the staples 123, the cover 11 is disengaged from the base member 12 and put a stack of staples 123 across the two side walls 122. The cover 11 is then engaged with the base member 12 again. Nevertheless, because the spring 15 applies a force to the head 142 so that the hooks 143 could disengage from the positioning holes 112. Once the head 142 is disengaged from the cover 11, the spring 15 will bounce away and the user has to spend a lot of time to find it back. Therefore, the manufacturers firmly engage the hooks 143 with the positioning holes 112, once the staples are completely empty, a new set of cassette with pre-loaded staples is replaced. Obviously, this is not an ideal way to used because the whole set of the base member 12 and the cover 11 with the cap 14 are discarded every time replacing a new stack of staples.

The present invention intends to provide a staple cassette wherein the staples can be re-loaded from a top opening of the cassette without pivoting the cover.

SUMMARY OF THE INVENTION

In accordance with one aspect of the present invention, there is provided a staple cassette for staplers and the cassette comprises a base member having two side walls and two flanges extend from two sides of the base member. A first hook extends from an underside of the base member and is located close to a first end of the base member. An opening is defined through the underside of the base member and located close to a second end of the base member.

A pushing member is movably mounted onto the two side walls of the base member and has a second hook extending from an underside of the top. A spring has a first end hooked to the first hook on the base member and a second end of the spring extends through the opening and is engaged with the second hook on the pushing member.

A cover is mounted to the base member and includes a top and two side walls. A slot is defined through the top of the cover and an opening is defined through the top of the cover. The two side walls of the base member are located between the two side walls of the cover. A top piece is slidably engaged with the opening.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
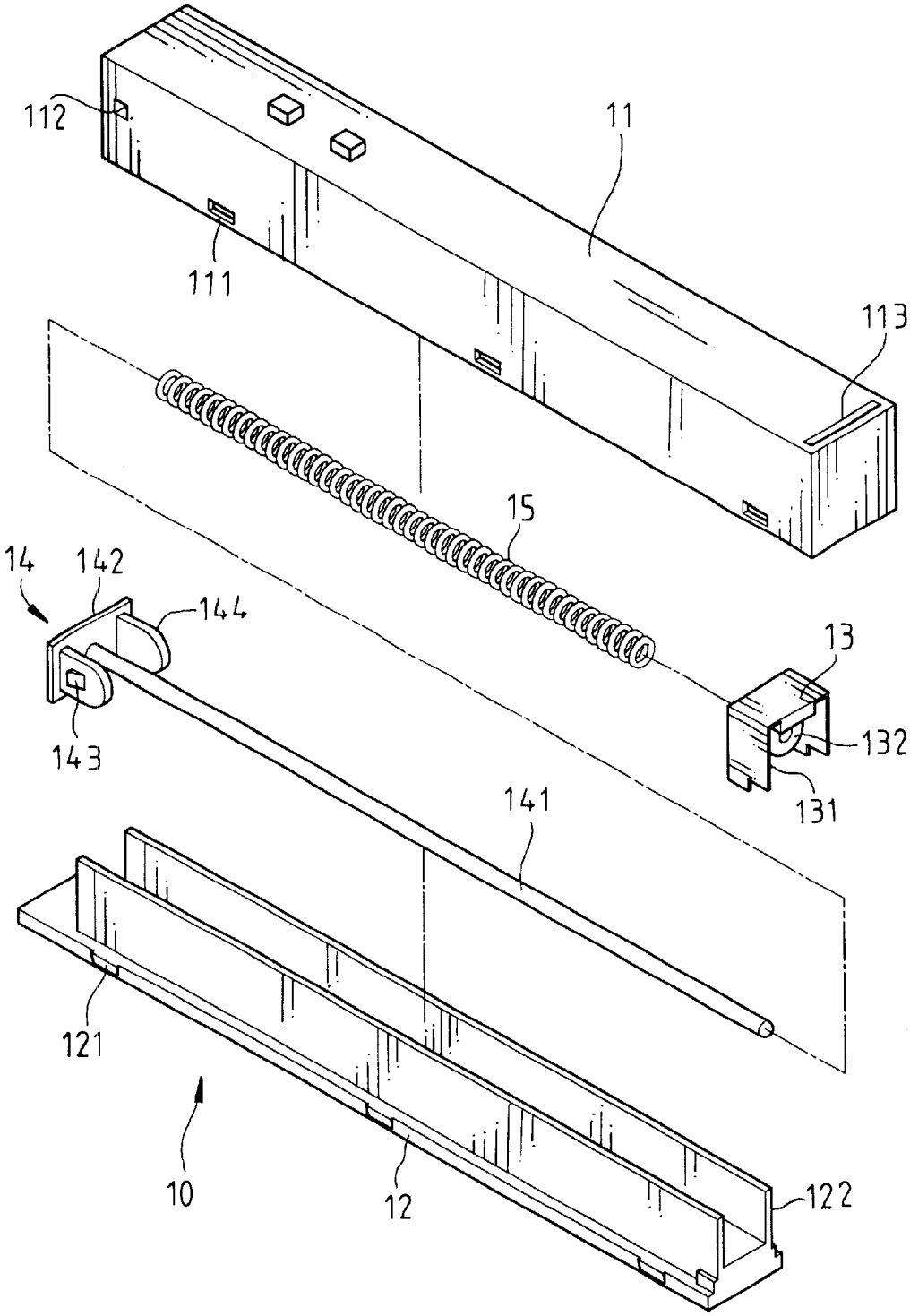
FIG.1 PRIOR ART
FIG. 1 is an exploded view to show a conventional staple cassette.
Figure 2:
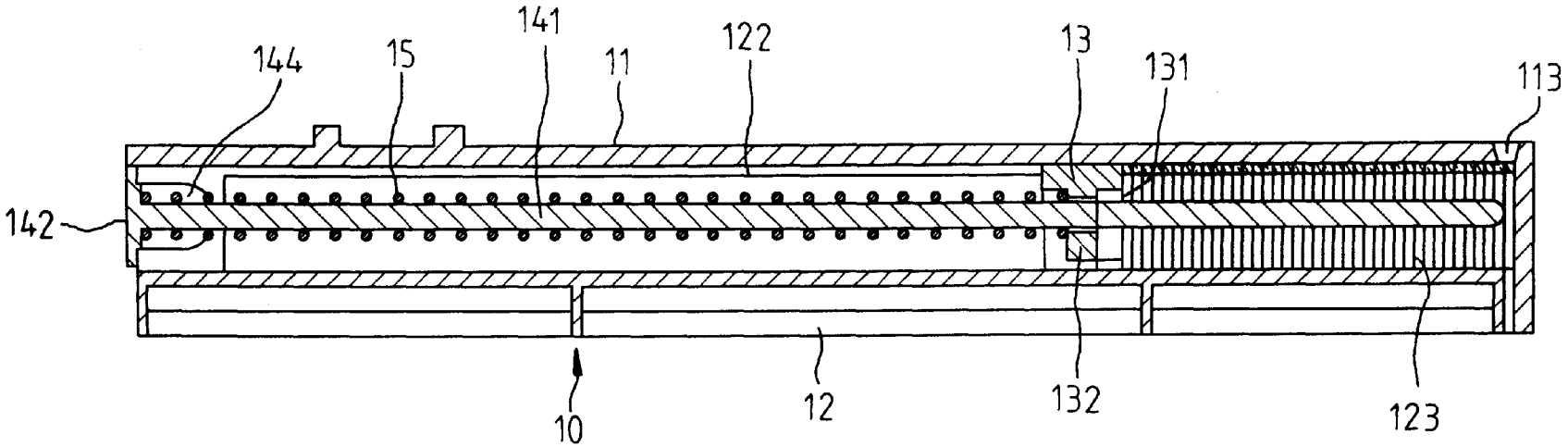
FIG.2 PRIOR ART
FIG. 2 is a cross sectional view to show conventional staple cassette.
Figure 3:
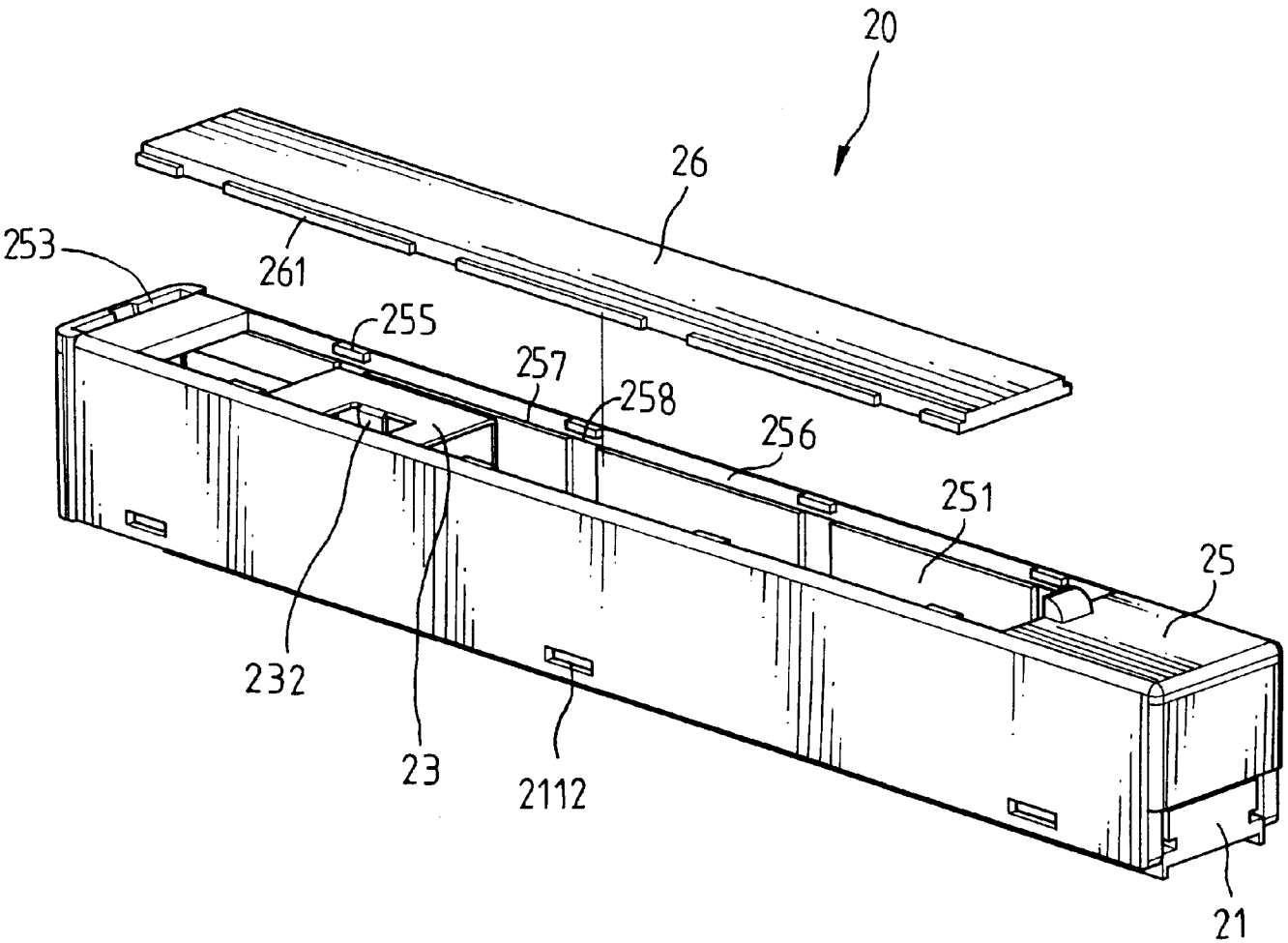
FIG. 3 is an exploded view to show the staple cassette with the top piece removed from the cover.
Figure 4:
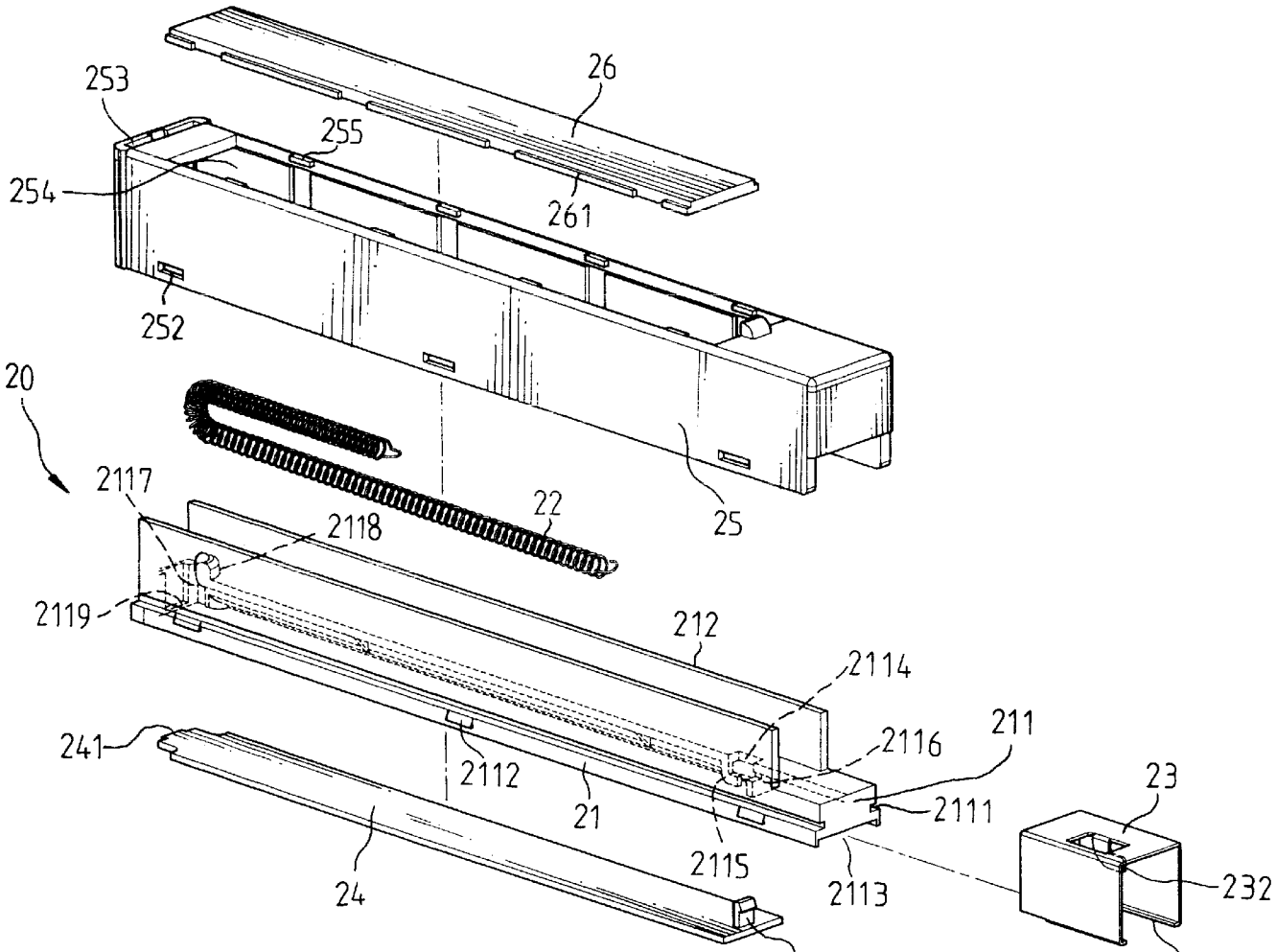
FIG. 4 is an exploded view to show the staple cassette of the present invention.
Figure 5:
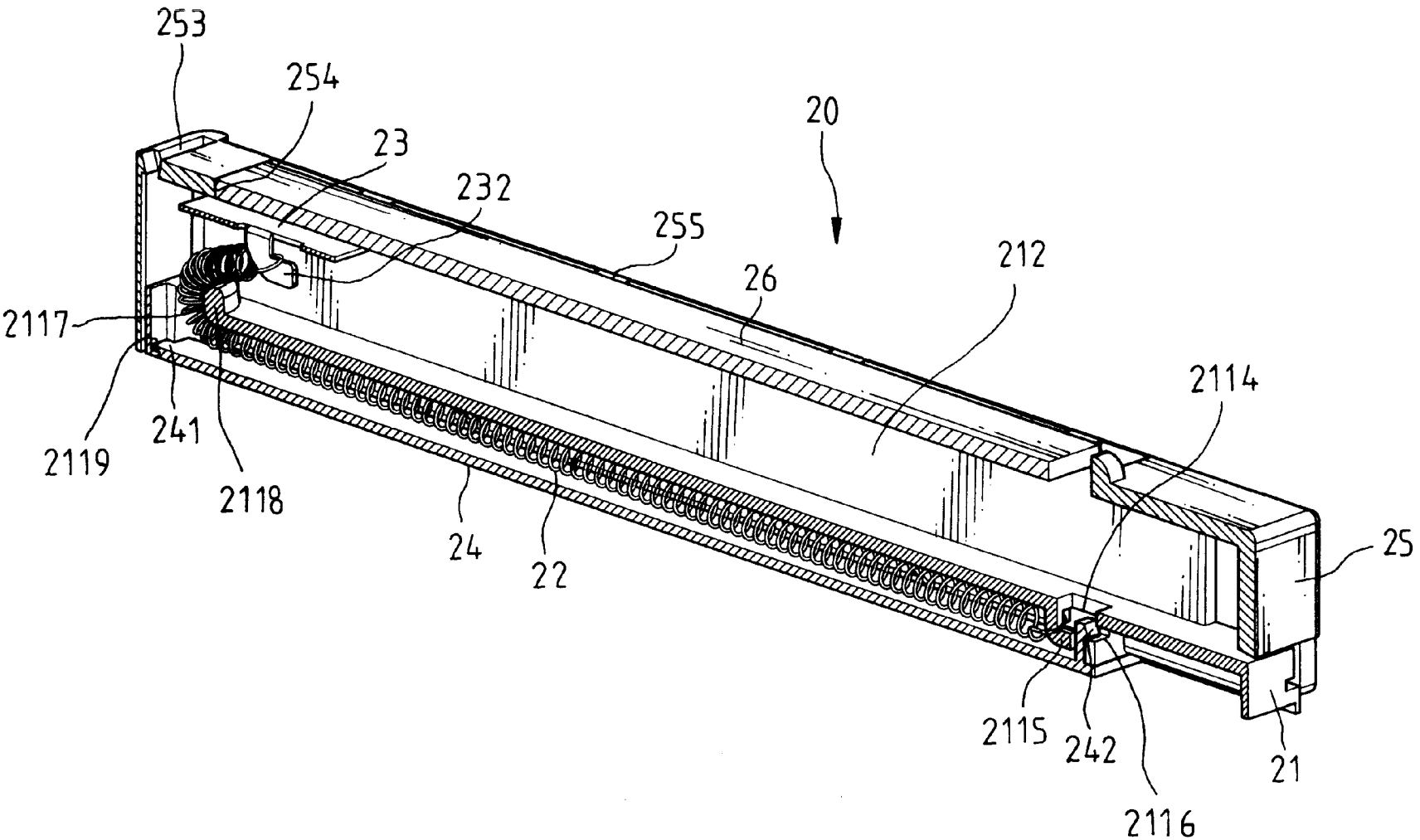
FIG. 5 is a perspective view, partly removed, of the staple cassette of the present invention.

Referring to FIGS. 3 to 5, the staple cassette 20 of the present invention comprises a base member 21 which has two side walls 212 on a side thereof and two flanges extend from two sides of the body 211 of the base member 21 so as to define a receiving space 2113 on the other side. Two grooves 2111 are defined in the two sides of the body 211 of the base member 21. A hole 2114 is defined through the underside of the base member 21 and a first engaging member 2116 is located beside the hole 2114. A first hook 2115 extends from the underside of the base member 21 and located close to a first end of the base member 21. An opening 2117 is defined through the underside of the base member 21 and located close to a second end of the base member 21. A guide member 2118 extends from a top of the base member 21 and located beside the opening 2117. A recess 2119 defined in an inside of the second end of the base member 21. A plurality of engaging lugs 2112 extend from the two sides of the base member 21.

A pushing member 23 has a top and two sides w herein two ridges 231 extend from the two respective insides of the two sides and are engaged with the two grooves 2111 of the base member 21. The two sides of the pushing member 23 are mounted to two respective outsides of the two side walls 212 of the base member 21. A second ho ok 232 extends from an underside of the top.

Figure 8:
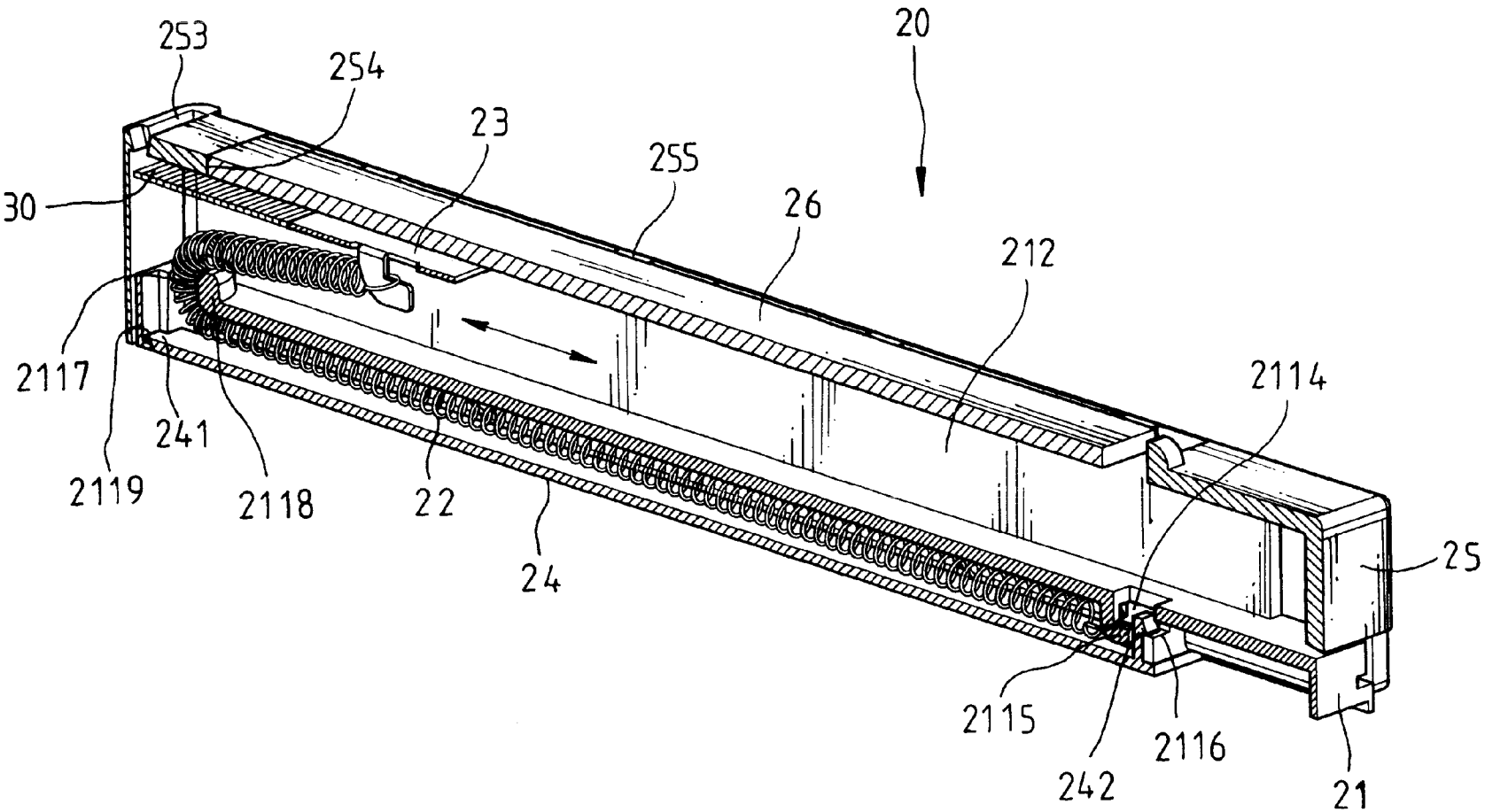
FIG. 8 shows staples in the base member are urged by the pushing member.

A spring 22 has a first end hooked to the second hook 232 on the pushing member 23 and a second end of the spring 22 extends through the opening 2117 and is guided by the guide member 2118 and engaged with the first hook 2115 on the base member 21. The pushing member 23 are then pulled by the spring 22 to urge the staples 30 as shown in FIG. 8.

Figure 6:
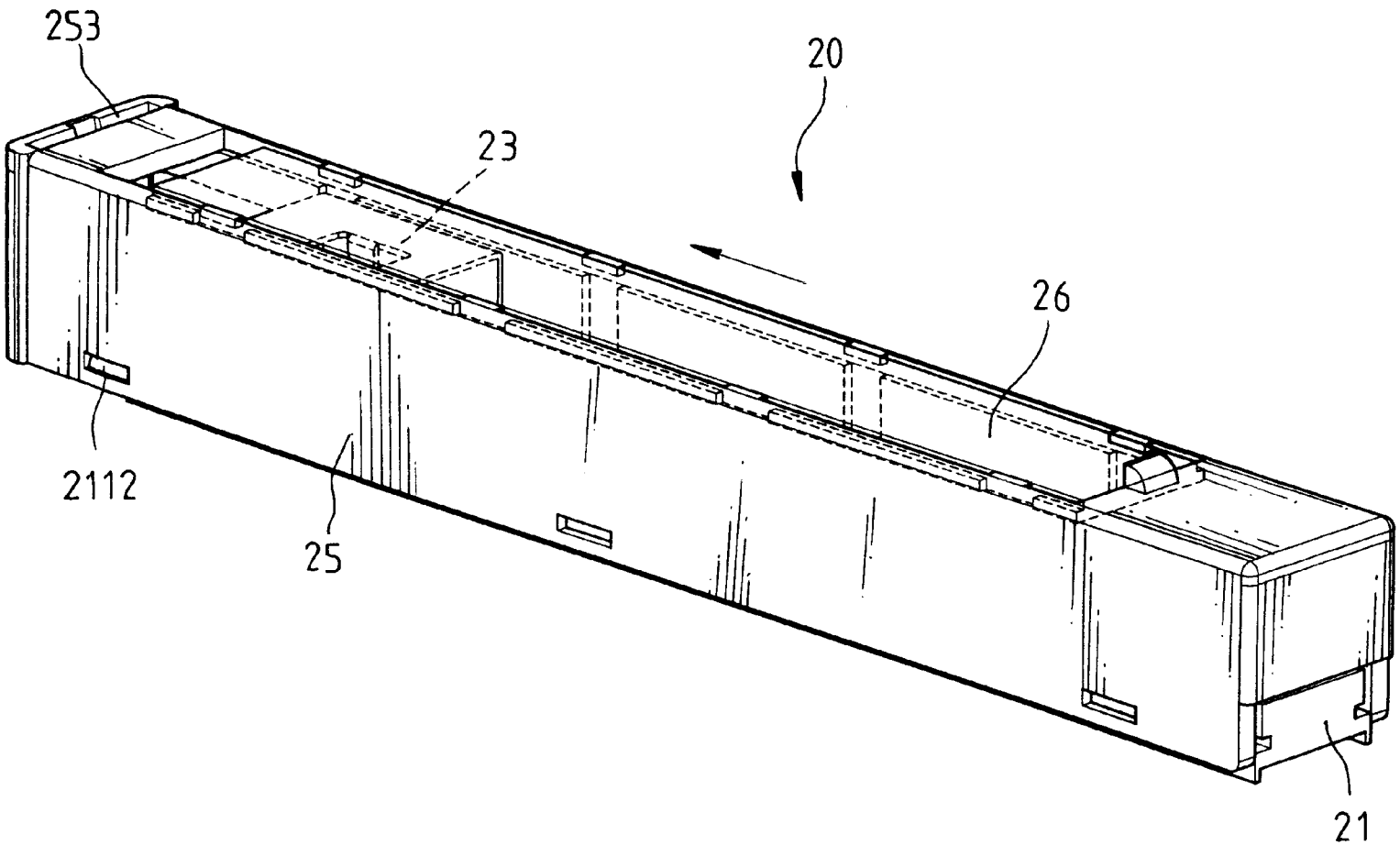
FIGS. 6 and 7 show the top piece is slidably engaged with the top opening of the cover.
Figure 7:
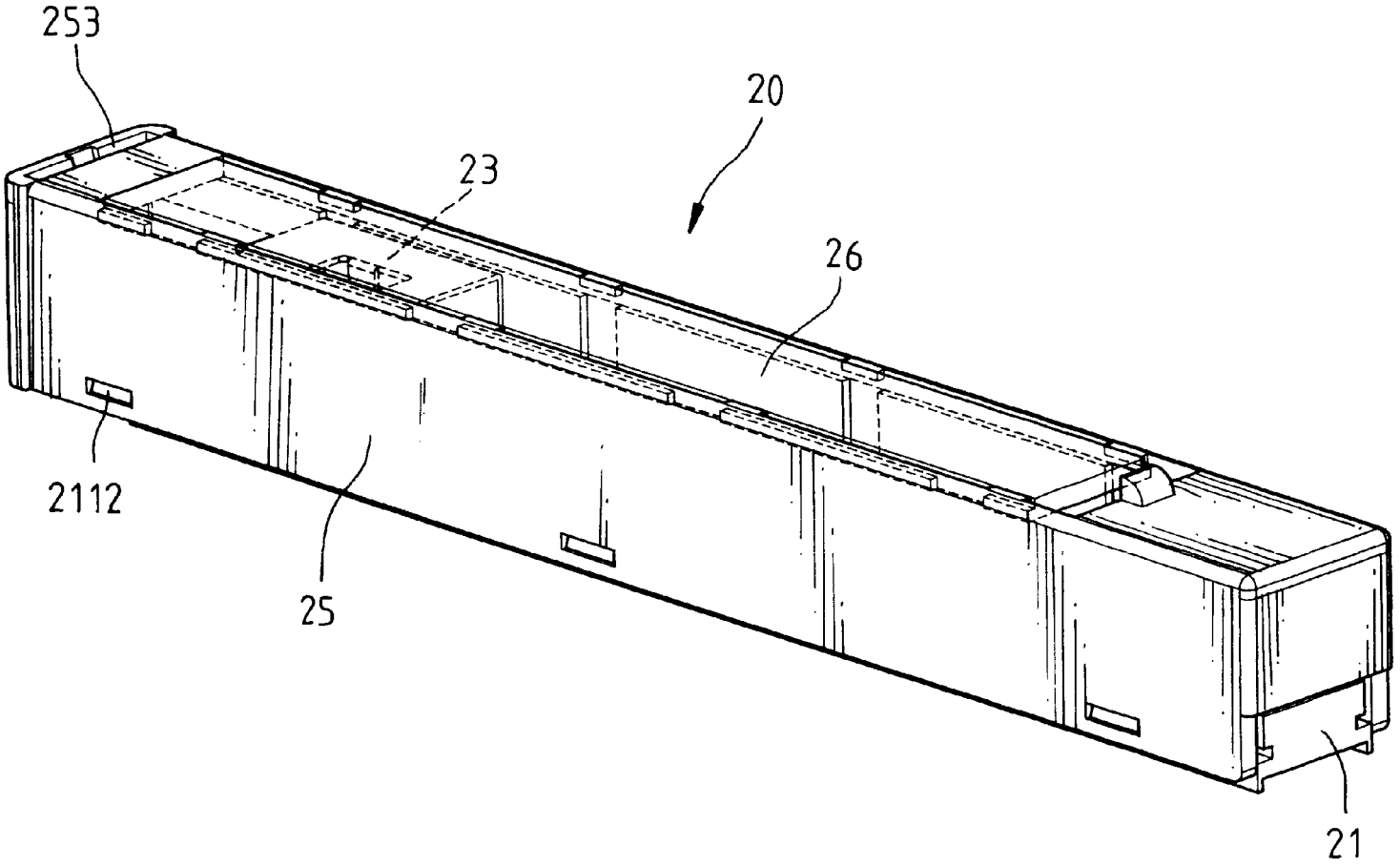

A cover 25 includes a top and two side walls. The cover 25 is mounted to the base member 21 and a space 251 is defined between the two side walls so as to receive staples 30 as shown in FIG. 8. A plurality of slots 252 are defined through the two side walls of the cover 25. The engaging lugs 2112 on the base member 21 are en gaged with the slots 252. The two side walls 212 of the base member 21 are located between the two side walls of the cover 25. A slot 253 is defined through the top of the cover 25 so that a pushing plate on the arm of a stapler is movably inserted through the slot 253 to push a staples 30 as shown in FIG. 8. An opening 254 is defined through the top of the cover 25 and a pluraity of stops 255 and an elongate protrusion 257 extend from two insides of the two side walls of the cover 25. Intervals 256 are defined between the stops 255 and a gap is defined between the stops 255 and the elongate protrusion 257. Further referring to FIGS. 6 and 7, a top piece 26 has blocks 261 extending from two sides thereof and the blocks 261 are inserted in the intervals and the top piece 26 is able to be slid into the gap so as to close the opening 254.

A bottom plate 24 is engaged with the receiving space 2113 and has a second engaging member 242 on a first end thereof. The second engaging member 242 is engaged with the first engaging member 2116. A first end of the bottom plate 24 has an insertion 241 extending therefrom and the insertion 241 of the bottom plate 24 is engaged with the recess 2119.

After the staples 30 are used out, the user simply slides the top piece 26 to open the opening 254 of the cover 25 and pulls the pushing member 23, and loads a stack of the staples 30 in the space 251. This is a totally different way to load the staples and no pivoting action of the base member 21 and the cover 25 is required.

While we have shown and described the embodiment in accordance with the present invention, it should be clear to those skilled in the art that further embodiments may be made without departing from the scope of the present invention.

What is claimed is:

1. A staple cassette comprising:

a base member having two side walls and two flanges extending from two sides of the base member so as to define a receiving space, a first hook extending from an underside of the base member and located close to a first end of the base member, an opening defined through the underside of the base member and located close to a second end of the base member;

a pushing member having a top and two sides which are mounted to two respective outsides of the two side walls of the base member, a second hook extending from an underside of the top;

a spring having a first end hooked to the second hook on the pushing member and a second end of the spring extending through the opening and engaged with the first hook on the base member;

a cover mounted to the base member and including a top and two side walls, a slot defined through the top of the cover and an opening defined through the top of the cover, the two side walls of the base member located between the two side walls of the cover, and a top piece slidably engaged with the opening.

2. The cassette as claimed in claim 1, wherein two grooves are defined in the two sides of the base member and the pushing member has two ridges which are engaged with the two grooves.

3. The cassette as claimed in claim 1, wherein the cover has a plurality of stops and an elongate protrusion extending from two insides of the two side walls of the cover, intervals defined between the stops and a gap defined between the stops and the elongate protrusion, the top piece having blocks extending from two sides thereof so that the blocks are inserted in the intervals and slid into the gap.

4. The cassette as claimed in claim 1, wherein a hole is defined through the underside of the base member and a first engaging member is located beside the hole, a bottom plate engaged with the receiving space and having a second engaging member on a first end thereof, the second engaging member engaged with the first engaging member, a first end of the bottom plate having an insertion extending therefrom, the base member having a recess defined in an inside of the second end thereof and the insertion of the bottom plate engaged with the recess.

5. The cassette as claimed in claim 1, wherein the base member has a plurality of engaging lugs on the two sides thereof and the cover has a plurality of slots defined through the two side walls thereof, the engaging lugs engaged with the slots.

* * * * *